United States Patent [19]

Kudlacek

[11] 4,057,220

[45] Nov. 8, 1977

[54] RATCHET TYPE OPERATOR FOR CABLE WINCHES AND THE LIKE

[76] Inventor: Donald S. Kudlacek, 3412 Oak St., Longview, Wash. 98632

[21] Appl. No.: 694,658

[22] Filed: June 10, 1976

[51] Int. Cl.[2] ..... B66D 1/00

[52] U.S. Cl. ..... 254/186 HC; 74/578; 188/82.1; 188/82.34; 242/96; 242/99; 242/106

[58] Field of Search ..... 254/186 HC, 161–164; 188/82.1, 82.34, 82.7; 242/96, 99, 106, 100, 86.7, 77; 24/269, 71.2, DIG. 1; 74/578; 192/5, 6 R, 6 B

[56] References Cited

U.S. PATENT DOCUMENTS

| | | | |
|---|---|---|---|
| 84,919 | 12/1868 | Valentine et al. | 242/100 |
| 100,709 | 3/1870 | Annan | 188/82.7 |
| 1,314,658 | 9/1919 | Huber | 242/77 X |
| 1,571,677 | 2/1926 | Link | 188/82.34 X |
| 1,814,389 | 7/1931 | Jacobsen | 242/99 |
| 1,815,737 | 7/1931 | Judelson | 188/82.1 |
| 2,608,107 | 8/1952 | Robins et al. | 74/578 |

*Primary Examiner*—Robert J. Spar
*Assistant Examiner*—Donald W. Underwood
*Attorney, Agent, or Firm*—Oliver D. Olson

[57] ABSTRACT

A cable winch shaft, adapted for rotational mounting adjacent its opposite ends in laterally spaced supports, has an end extension formed as a ratchet gear which is confined in a cavity in a base member also adapted to be secured to one of the supports. An adjacent, communicating cavity in the base member guides the reciprocative movement of a spring-loaded ratchet arm provided at its inner end with a ratchet dog which is urged resiliently into engagement with the gear to secure the winch shaft against rotation in one direction but allowing its rotation in the opposite direction. The opposite end of the arm projects from the base member for manual manipulation, against the resistance of the spring loading, to disengage the dog from the gear and thus release the winch shaft for rotation in both directions. The terminal portion of the gear extension projects through an opening in the base member and is adapted for engagement of a crank by which to rotate the winch shaft, and the intermediate reel portion of the shaft includes means for releasably securing one end of a cable.

4 Claims, 4 Drawing Figures

RATCHET TYPE OPERATOR FOR CABLE WINCHES AND THE LIKE

BACKGROUND OF THE INVENTION

This invention relates to a ratchet type operator for controlling rotating of a cable winch or the like. In particular it relates to such an operator for installation in a cable operated device such as the tensioning control of a compound archery bow. There is a need in many applications for a small sized, inexpensive but reliable cable winch and operator therefor. For example, compound archery bows utilize tensioning control cables attached to the limbs and adjustable in length to vary the tension of the limbs. Heretofore, such length adjustments have been made by means of turnbuckles, which are slow and cumbersome to adjust and which are unreliable in performance, or by means of complex and costly gear-driven reels.

SUMMARY OF THE INVENTION

In its basic concept this invention provides a manually rotatable shaft operatively coupled to a ratchet gear resiliently engaged by a ratchet dog on a spring-loaded, reciprocative ratchet arm to allow shaft rotation in one direction only, the arm being movable to disengage the dog and gear to release the shaft for rotation in both directions.

It is by virtue of the foregoing basic concept that the principal objective of this invention is achieved; namely to overcome the aforementioned disadvantages and limitations of cable winch operators of the prior art.

Another object of this invention is to provide a cable winch operator of the class described having a manually releasable ratchet for allowing free rotation of the cable reel in either direction.

A further object of this invention is to provide a cable winch of the class described having novel means for releasably attaching a cable thereto.

A further object of this invention is to provide a cable winch operator of the class described having means for receiving a detachable crank.

A still further object of this invention is to provide an operator of the class described which is of simple construction for economical manufacture and ease of use.

The foregoing and other objects and advantages of this invention will appear from the following detailed description, taken in conjunction with the accompanying drawings of a preferred embodiment.

DESCRIPTION OF THE PREFERRED EMBODIMENT

Figure 1:
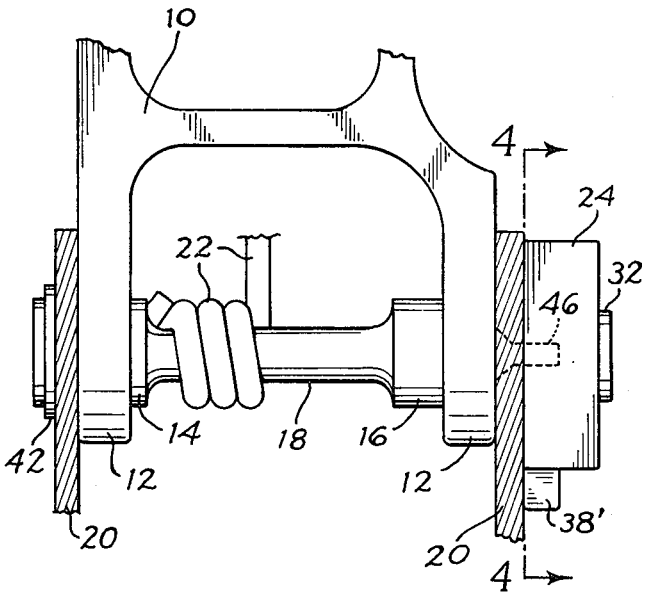
FIG. 1 is a fragmentary plan view, partially in cross section, of a cable winch and operator embodying the features of this invention, the same being illustrated in association with elements of a compound archery bow.
Figure 2:
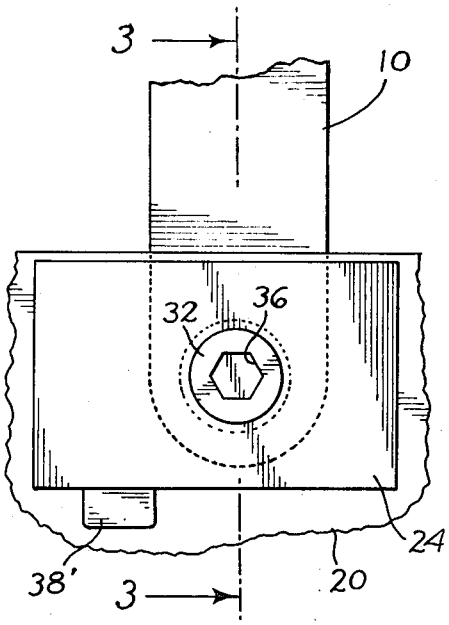
FIG. 2 is a fragmentary view, in elevation, as viewed from the right side of FIG. 1.

Referring to the drawings, the cable winch and operator of the present invention is illustrated in association with a tensioning control of a compound archery bow, of the type described in U.S. Pat. No. 3,841,295. The cable winch operator of this invention replaces the gear driven reel assembly illustrated in FIG. 9 of the patent. As in the patent, the tensioning control includes a pair of levers 10, one associated with each of the end segments of a bow string. Thus, the bow string end segment extending from the opposite limb component of the bow is connected to the outer end of the lever mounted adjacent the opposite end of the handle component of the bow. The inner portion of each lever is bifurcated, forming short, spaced arms 12 which are journaled rotatably on enlarged opposite end segments 14 and 16 of a cable winch shaft 18. These end segments are mounted for rotation in bearing openings in a pair of spaced side plates 20 connected to the central handle of bow (not shown). These plates are secured to opposite side surfaces of the opposite end portions of the handle component of the bow. Also, as in the aforementioned patent, the flexible control cable 22, secured at one end to the reel shaft 18, is trained over a pulley located near the outer extremity of the opposite bow limb and then is returned back to connection with the lever 10. The control cable thus operatively interconnects the lever and the associated limb such that rotation of the reel shaft to take in or pay out the cable causes the limb tension to be respectively increased or decreased.

Figure 3:
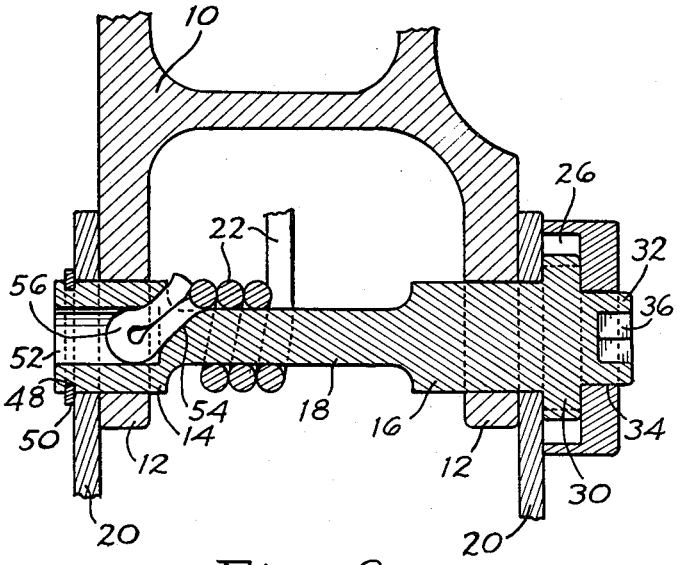
FIG. 3 is a fragmentary cross sectional view, taken on the line 3—3 of FIG. 2.
Figure 4:
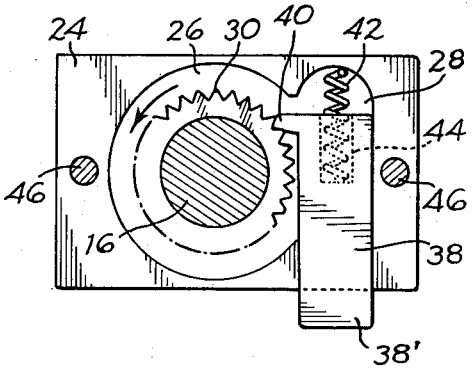
FIG. 4 is a cross sectional view taken on the line 4—4 of FIG. 1.

As best illustrated in FIGS. 3 and 4, the winch operator includes a base 24 defining a central circular cavity 26 and an intersecting rectangular cavity 28 which opens out of one edge of the base. A ratchet gear 30 is formed on, or otherwise integrated with, the end of shaft segment 16 and is confined freely for rotation within the circular cavity 26. An end extension 32 projects coaxially from the ratchet gear 30 through a bearing bore 34 in the base 24. A non-circular drive socket 36 is formed in the extension 32 for removable connection of a crank, for purposes described more fully hereinafter.

Slidably fitting within and guided by the rectangular cavity 28 is ratchet arm 38. Integrally attached to the upper end of the ratchet arm is ratchet dog 40 which is configured for engagement with ratchet gear 30. Spring 42 fits into a pocket 44 in the inner end of the ratchet arm and its outer end contacts the wall of the cavity urging the arm outwardly. Referring to FIG. 4, the length of the ratchet arm is such that its outer end 38' projects outwardly from the base when the dog 40 engages gear 30.

The base 24 is secured to one of the plates 20 by means of screws 46. The plate 20 thus retains the ratchet gear 30 and arm 38 in their respective cavities. In other applications not having a similar structural element 20, a cover plate is provided to close the cavities. A circumferential groove 48 near the outer end of end extension 14 receives snap ring 50 which abuts the adjacent plate 20 and thus maintains the plate 20 and adjacent arm 12 in closely abutting relationship.

Novel means is provided for securing one end of cable 22 detachably to the winch shaft 18. As best seen in FIG. 3, a cylindrical bore 52 is located axially in the end of shaft end segment 14 and it communicates at its inner end with a bore 54 which extends radially outward to the outer surface of the cable reel 18. The diameter of bore 52 is large enough to contain a loop 56 of cable 22, formed by doubling the latter, and the diameter of bore 54 is large enough to contain two lengths of the cable 22, side by side, but not large enough to pass the loop 56. The end of the control cable 22 is inserted radially inward through bore 54 and then axially outward through bore 52. It then is doubled over and the free end portion inserted back through the bores and the cable pulled tight, wedging the loop 56 thus formed within the bore 52.

The control cable then may be wound onto the cable reel 18 by rotating a crank installed removably in socket 36 until proper bow tension is obtained. The crank then may be removed from socket 36, so that it does not interfere with or otherwise disturb the archer in the normal use of the bow.

It will be noted that ratchet arm 38 is urged downwardly by spring 42, causing dog 40 to engage the gear 30 in a manner allowing rotation of the winch in one direction, counterclockwise in FIG. 4, and preventing its rotation in the opposite direction. Thus, once the cable is wound onto the cable reel, the reel is locked automatically, preventing unwinding of the cable.

When it is desired to reduce or release the bow tension, the outwardly extending portion 38' of the ratchet arm is manually pressed inwardly, against the tension of spring 42, thereby disengaging dog 40 from gear 30 and releasing the latter for rotation in either direction. In this manner, by selectively manipulating the ratchet arm the winch may be caused to rotate one tooth at a time, allowing gradual release of the bow tension.

It is to be observed, particularly from FIG. 4, that the cavity 28 and ratchet arm 38 are disposed tangentially with respect to the cavity 26 and ratchet gear 30, respectively, and that dog 40 engages the ratchet gear 30 at a point displaced circumferentially from a diametrical line extending through the ratchet gear 30 normal to the direction of reciprocation of the ratchet arm 38. By this arrangement the force of clockwise rotation of the ratchet gear 30, by a load inducing rotation of shaft 18, is impressed upon the dog 40 in the direction substantially normal to the longitudinal axis of the ratchet arm 38. Accordingly, such force is applied substantially entirely along the outer longitudinal edge of the cavity 28, by the outer longitudinal edge of the ratchet arm 38, thereby minimizing the shear forces on the ratchet dog 40 and arm 38 and enabling the ratchet gear 30 to resist correspondingly high clockwise rotational forces applied to shaft 18. On the other hand, counterclockwise rotation of the ratchet gear 30 is resisted only by the minimum force of spring 42, since the direction of force on dog 40 is substantially parallel to the direction of reciprocation of arm 38.

It will be apparent to those skilled in the art that various changes may be made in the size, shape, type, number and arrangement of parts described hereinbefore. For example, although the operator is shown located in the tensioning control of a compound archery bow, it may also be used in many other applications requiring rotational control of a shaft in one direction. An existing cable winch or other rotary shaft may be coupled to the ratchet gear 30, in any desired manner, for control by the ratchet arm 38 and dog 40. The crank socket 36 may be provided in the opposite end of the shaft, as in bore 52, or it may be an external, non-circular extension for cooperative connection of a crank having a matching socket. These and other modifications may be made, as desired, without departing from the spirit of this invention.

Having thus described my invention and the manner in which it may be used, I claim:

1. A ratchet type operator for a rotatable shaft, comprising:

a. a base, b. a first cavity in the base, c. a shaft, d. a ratchet gear secured to one end of the shaft and confined within the first cavity, e. a second cavity in the base tangent to and communicating with the first cavity, f. a ratchet arm within and guided by the second cavity for reciprocation tangentially with respect to the ratchet gear, g. a ratchet dog on the ratchet arm extending laterally therefrom and arranged for releasable engagement with the ratchet gear, at a point displaced circumferentially from a diametrical line extending through the ratchet gear normal to the direction of reciprocation of the ratchet arm whereby a force on the ratchet dog is transferred through the ratchet arm and substantially entirely along an outer longitudinal edge of the second cavity by an outer longitudinal edge of the ratchet arm minimizing the shear forces on the ratchet dog, and h. spring means engaging said ratchet arm for urging the ratchet dog resiliently into engagement with the ratchet gear, allowing rotation of the shaft in one direction and preventing rotation of the shaft in the opposite direction.

2. The ratchet type operator of claim 1 wherein the ratchet arm and its guide cavity are configured such that the arm is movable manually, tangent to the ratchet gear, against the resistance of the spring means to disengage the ratchet dog from the ratchet gear, allowing free rotation of the shaft in either direction.

3. The ratchet type operator of claim 1 wherein the shaft includes axially spaced journal segments defining a cable winch between them, and spaced bearings support the journal segments for rotatably mounting the cable winch.

4. The ratchet type operator of claim 1 including an extension projecting from the ratchet gear through an opening in the base, and non-circular drive connection means on the extension for removable connection of a drive crank, for rotating the shaft.

* * * * *